US010577142B2

(12) United States Patent
Alquati

(10) Patent No.: US 10,577,142 B2
(45) Date of Patent: Mar. 3, 2020

(54) DEVICE FOR SEALING AND CUTTING IN A PACKAGING APPARATUS, A PACKAGING PROCESS AND A PACKAGING APPARATUS

(71) Applicant: Cryovac, Inc., Duncan, SC (US)

(72) Inventor: Massimo Alquati, Milan (IT)

(73) Assignee: Cryovac, LLC, Charlotte, NC (US)

( * ) Notice: Subject to any disclaimer, the term of this patent is extended or adjusted under 35 U.S.C. 154(b) by 813 days.

(21) Appl. No.: 14/561,254

(22) Filed: Dec. 5, 2014

(65) Prior Publication Data

US 2015/0175288 A1 Jun. 25, 2015

(30) Foreign Application Priority Data

Dec. 20, 2013 (EP) ..... 13199224

(51) Int. Cl.

| | |
|---|---|
| ***B65B 59/00*** | (2006.01) |
| ***B65B 59/02*** | (2006.01) |
| ***B65B 61/06*** | (2006.01) |
| ***B65B 51/00*** | (2006.01) |
| ***B65B 9/10*** | (2006.01) |

(52) U.S. Cl.

CPC ..... *B65B 59/02* (2013.01); *B65B 9/10* (2013.01); *B65B 51/00* (2013.01); *B65B 61/06* (2013.01)

(58) Field of Classification Search

CPC ..... B26D 7/2628; B65B 9/10; B65B 9/213; B65B 51/00; B65B 61/04; B65B 61/06

USPC ..... 53/450, 547, 548, 432

See application file for complete search history.

(56) References Cited

U.S. PATENT DOCUMENTS

| | | | | |
|---|---|---|---|---|
| 4,288,968 | A * | 9/1981 | Seko | B29C 65/18 156/583.1 |
| 5,787,777 | A * | 8/1998 | Ballestrazzi | B26D 1/095 83/100 |
| 5,941,048 | A * | 8/1999 | Spitler | H04N 1/4446 156/441.5 |
| 6,058,818 | A * | 5/2000 | Dieterlen | B26D 7/2628 53/562 |
| 6,662,527 | B1 * | 12/2003 | Suga | B29C 65/18 53/374.3 |
| 2008/0115638 | A1 * | 5/2008 | Nalle, III | B26D 7/10 83/16 |
| 2013/0094790 | A1 | 4/2013 | Garavaglia et al. | |

* cited by examiner

*Primary Examiner* — Chelsea E Stinson
(74) *Attorney, Agent, or Firm* — Jon M. Isaacson

(57) ABSTRACT

A device for sealing and cutting a film in a packaging apparatus, a packaging apparatus including the device, and a process using the device are provided. The device includes first and second members, one or both of which are movable with respect to the other. One of the members includes an elongated blade, and one of the members includes a cutting means positionable in a plurality of positions. The process includes creating a first seal on a tubular film, thereby creating a semi-sealed package, creating a second seal on the semi-sealed package, thereby creating a sealed package, creating a substantially transversal cut in the tubular film, thereby separating the semi-sealed package from a subsequent portion of the tubular film, and creating an incision in a section of the first or second seal, the incision defining a pre-determined breaking zone in the tubular film of the sealed package.

20 Claims, 7 Drawing Sheets

DEVICE FOR SEALING AND CUTTING IN A PACKAGING APPARATUS, A PACKAGING PROCESS AND A PACKAGING APPARATUS

This application claims the benefit of European patent application serial no. 13199224.0 filed on Dec. 20, 2013.

TECHNICAL FIELD

The present invention relates to a packaging process and a packaging apparatus. The packaging process includes moving a packaged product through a sealing station where the packaging is sealed and the seal is provided with an incision facilitating easy rupture of the packaging prior to use of the product. The invention also relates to a device or tool for cutting and sealing a film in a packaging apparatus.

BACKGROUND ART

A packaging apparatus can be used to package a food product. The product can be a naked product or a product pre-loaded onto a tray. A tube of plastic wrap is continuously fed through a bag/package forming, filling and sealing apparatus. The film and the product are joined, for example the product is deposited on the film or the film is wrapped around the product. In some examples, the naked product is fed through an infeed belt. A tube is created around the product by sealing opposite longitudinal edges of the film. Alternatively, the product is placed in the tube and a leading edge of the packaging is sealed. Then the tube is sealed at the trailing edge (at the upstream end) of the package and is severed from the continuously moving tube of packaging.

The tube can be provided as a tube, or be formed from two films or webs sealed longitudinally at two longitudinal edges, or from a single film that is folded over and sealed along its longitudinal edges.

Sealing bars can be used to seal the package, wherein a lower bar and an upper bar are moved with respect to one another in order to contact each other, squeezing the packaging material in between and providing one or more seals. The sealing bars typically also form an adjacent seal, which comprises the opposite end of the next following package, thereby providing one semi-sealed (e.g. having an open end) and one sealed package during a single packaging process step.

The seals are typically transversally extending regions of packaging material that have been processed to provide a seal between the inside of the packaging and the environment. In some cases it is desirable to provide packaging that can easily be opened by a user prior to use of the packaged product. To this aim, the seal on one end of the packaged product can be provided with an incision or pre-cut section, which provides a pre-defined rupture zone, ensuring controlled rupture of the packaging film upon manual interaction of a user, thereby facilitating easy opening of the packaging and removal of the product contained therein.

The position of the pre-defined rupture zone can be adjusted depending on the product to be packaged, the film used, further use of the product when opened, and a number of other factors. For example, the pre-defined rupture zone can be positioned substantially in the middle of a transversal seal or near to one of the edges of the package.

The seals and rupture zones are created by a set of sealing bars that includes a blade for cutting the packaging between the seals of two subsequently packaged products and a knife for creating the pre-defined rupture zone or pre-cut section. The pre-cut section is designed to leave the seal intact while providing a pre-determined breaking point at which the packaging film is designed to rupture in a controlled manner upon manual interaction.

A packaging apparatus is typically used for numerous different products with respect to the type of product, size, weight, composition, etc. The problem is to provide different kinds of packages with respective rupture zones either substantially in the middle of a seal or with an offset towards one of the edges of the product. In some cases, the use of the product requires breaking the seal while leaving the packaging substantially intact for further processing (e.g., heating). In other cases, the use of the product requires breaking the seal and rupturing the entire package in order to expose the entire contents of the package.

The manner of breaking the seal at the pre-defined rupture zone depends on a number of factors, for example, the type and composition of the packaging film, the packaged product, etc. An additional factor includes the size of the pre-defined rupture zone. Providing a larger or smaller pre-defined rupture zone influences the rupturing process. Another additional factor includes the amount of air trapped in the packaging material near and around the pre-defined rupture zone. The pre-defined rupture zone can include pockets of air, separately and/or substantially sealed from the environment in order to provide a gripping area. The amount of air and, hence, the shape and composition of the gripping area, influences the rupturing process.

Gas can be trapped in the package in the space between the product and the film after sealing both ends. It is sometimes desirable to deflate the package so as to reduce the package volume. Additionally, evacuation of the gas from the package can improve packaging appearance after heat shrinking and can also reduce the possibility of deterioration of the product due to exposure to oxygen or other gas. For example, some foods such as cheese can oxidize or mold over a period of time if a suitable atmosphere is not contained within the package.

WO 2013/055848 describes a packaging article including a heat-shrinkable multilayer film having a heat seal extending down a length of the packaging article along longitudinal edges of the film, a heat seal extending across a width of the packaging article and providing a bottom of the internal volume within the packaging article, and a heat seal extending across the width of the packaging article and providing a top of the internal volume. The packaging article also comprises a skirt between the heat seal across the width of the article and the bottom edge of the article. The skirt has tear initiators, which are cuts through the skirt, with each of the tear initiators having an inward end and an outward end. The inward ends are closer to both the first two heat seals than are the outward ends, and the outward ends are closer to the bottom edge than are the inward ends. The tear initiators are positioned relative to the first heat seal so that a superimposed straight line extending through the inward and outward ends of each tear initiator intersects a superimposed straight line extending through the ends of the first heat seal at a lesser included angle of from 25 degrees to 55 degrees, with the inward end of each the first and second tear initiators terminating at a location which is from 3 to 30 millimeters from the first heat seal and 3 to 50 millimeters from the second heat seal. The heat-shrinkable film exhibits an Elmendorf tear strength of from 0.7N to 2N after shrinking.

U.S. Pat. No. 5,673,534 describes a re-closable bag that includes a detachable re-closure tie having a tail portion formed by a series of spaced elongated seals and a closed loop. Apparatus for forming the re-closure tie with a bag includes first and second sealing jaws with external and internal grippers for holding web material. The first sealing jaw carries cutting and perforating knives and a cooling block that directs cooling air onto the knives to prevent the knife temperature from rising to the melting temperature of the web material. Each sealing jaw contains a heating block with complementary sealing surfaces for forming various seals including the seals that form the tail portion of the re-closure tie. U.S. Pat. No. 5,284,002 describes a storage bag and a method and apparatus for forming the storage bag. The storage bag contains a re-closure tie formed as an integral marginal portion of the bag beyond an edge of the bag. The marginal portion includes overlying layers of bag material that form an elongated structure along an axis with first and second ends. A fused closure is formed in the marginal portion parallel to the axis and over a portion of the marginal portion spaced from one end thereof. This structure defines a tail and open loop that wrap around an opened bag thereby to close the bag in a positive fashion. U.S. Pat. No. 5,169,696 describes a transversely tearable film and pouches made therefrom. The transversely tearable laminate comprises a machine direction oriented linear low density polyethylene film adhesively laminated on at least one side to a sealant film, the sealant film having an Elmendorf tear in the machine direction of at least about 2 g per micron. None of these documents describe how re-closure ties or tearable portions of film can be modified in order to adapt to different applications.

U.S. Pat. No. 4,650,079 describes an easy-to-open synthetic resin bag, which includes a bag body constituted by a laminated film formed by laminating several layers of synthetic resin film, a tear string bonded to part of an inner surface of the bag body corresponding to the opening thereof, and a tab formed at an end of the tear string. Pulling the tear string by the tab enables one side surface of the bag to be torn open, thereby allowing the bag to be opened. Also disclosed is a bag manufacturing apparatus capable of automatically bonding the tear string to the part of the inner surface of the bag body corresponding to the opening thereof when the bag body is being formed by employing the laminated film of the above kind. The document does not describe how packaging material or tear strings are or can be configured for different applications.

U.S. Pat. No. 6,343,876 describes a packaging machine, in which below a laterally sealing mechanism a seal opening notch forming mechanism is arranged, below which a perforation slitter mechanism is disposed to form perforations in a center longitudinally sealed portion of left and right parallel package bags. Further blow the perforation slitter mechanism there is a cutting mechanism that cuts laterally sealed portions of vertically connected package bags and delivers separated package bags. WO0164516 describes a filling and packaging machine capable of sealing packaged substance such as liquid, powder, or viscous substance by sealing a package film on three or four longitudinal and lateral sides thereof, comprising a trimming mechanism having a trimming blade for cutting an ear parts forming cut wastes by the vertical seal parts of continuously fed package bags and a sucking mechanism having a sucking port for sucking to collect the ear parts forming the cut wastes provided on the downstream side of the trimming mechanism, whereby the cut wastes of the package bags can be excluded satisfactorily. U.S. Pat. No. 4,981,374 describes a machine for automatically filling plastic bags with liquid or particulate material, which moves a continuous web of such bags through a number of serially positioned work stations. The machine can be manually adjusted to handle bags of different width. An additional adjustment by means of stepper motors is also provided.

An aim of the present invention is to provide a packaging process in which the seal of a packaged product is provided with a pre-defined rupture zone wherein the size and/or position of the pre-defined rupture zone can be easily adjusted depending on a number of factors including product properties such as size, composition, and type. Another aim of the present invention is to provide a packaging apparatus adapted to form a seal having adjustable size and/or position of a pre-defined rupture zone. In particular it is a goal of the invention to provide a packaging apparatus capable of executing the packaging process of the invention. Furthermore, it is an aim of the invention to provide a device for cutting and sealing a film in the above packaging apparatus or process.

SUMMARY OF INVENTION

According to the invention, in a $1^{st}$ aspect there is provided a device for sealing and cutting a film in a packaging apparatus, comprising a first member and a second member, wherein the first member is movable with respect to the second member, or the second member is movable with respect to the first member, or both the first and second members are movable with respect to each other. One of the first and second members comprises an elongated blade and one of the first and second members comprises a cutting means, wherein the cutting means are positionable in a plurality of positions with respect to the respective member.

In a $2^{nd}$ aspect according to the first aspect, the device has a first configuration, in which the first and second members are spaced apart from one another, and a second configuration, in which the first and second members are substantially in contact with one another. Optionally, the first and second members respectively comprise first and second working surfaces and the first and second working surfaces are substantially in contact with each other, when the first and second members are in the second configuration.

In a $3^{rd}$ aspect according to the $2^{nd}$ aspect, the one of said first and members comprising the cutting means further comprises a support for the cutting means.

In a $4^{th}$ aspect according to the $3^{rd}$ aspect, the support is configured to releasably hold the cutting means.

In a $5^{th}$ aspect according to one of aspects 3 or 4, the support is movably coupled to the respective member so that the support is movable parallel to a longitudinal extension of the elongated blade and positionable with respect to the respective member, thereby positioning the cutting means in any one of the plurality of positions.

In a $6^{th}$ aspect according to the $5^{th}$ aspect, the one of said first and second members comprising the cutting means further comprises abutment elements arranged at opposite first and second ends thereof and the support is movable between a first end-run position, in which the support abuts the abutment element located at the first end of the respective member, and a second end-run position, in which the support abuts the abutment element located at the second end of the respective member.

In a $7^{th}$ aspect according to one of aspects 5 or 6, the one of said first and second members comprising the cutting means further comprises first movement means configured to move the support into any one of the plurality of positions.

In an $8^{th}$ aspect according to one of aspects 5, 6, or 7, the plurality of positions comprises a number of discrete positions.

In a $9^{th}$ aspect according to any one of the preceding aspects, the one of said first and second members comprising the cutting means is configured to receive, in the support, any one of a plurality of interchangeable cutting means, wherein each of the plurality of interchangeable cutting means has a size, a shape, and/or a form different from other interchangeable cutting means, and wherein the cutting means are releasably coupled to the respective member so that any one of the interchangeable cutting means can be coupled to the support of the respective member.

In a $10^{th}$ aspect according to any one of the preceding aspects, the one of said first and second members not comprising the cutting means comprises a corresponding seating for at least partially receiving the cutting means.

In an $11^{th}$ aspect according to the $10^{th}$ aspect, the one of said first and second members comprising the seating further comprises a seat holder configured for delimiting the seating. The seat holder is movably coupled to the respective member so that the seat holder is movable parallel to a longitudinal extension of the elongated blade and positionable in a plurality of distinct positions with respect to the respective member, thereby allowing aligning the seating to the cutting means, so that when the device is in the second configuration, the seating is configured for receiving the cutting means.

In a $12^{th}$ aspect according to the $11^{th}$ aspect, the one of said first and second members comprising the seating comprises abutment elements arranged at opposite first and second ends thereof. The seat holder is movable between a first end-run position in which the seat holder abuts the abutment element located at the first end of the one of said first and members comprising the seating and a second end-run position in which the seat holder abuts the abutment element located at the second end of the one of said first and members comprising the seating.

In a $13^{th}$ aspect according to any one of aspects 7 to 12, the one of said first and second members comprising the seating further comprises second movement means configured to move the seat holder into any one of the plurality of positions.

In a $14^{th}$ aspect according to the $13^{th}$ aspect, the device further comprises a control unit connected to the first and/or second movement means. The control unit is configured to control the first and second movement means so that a current position of the cutting means and/or the support with respect to the respective member is aligned with a current position of the seating and/or the seat with respect to the other respective member.

In a $15^{th}$ aspect according to the any one of aspects 7 to 14, the first member comprises a first actuator configured to act upon the first movement means in order to position the cutting means. Optionally, the first movement means are operably coupled to the support so that the first movement means are configured to position the cutting means by moving the support. Also optionally, the first actuator is an electric motor configured to rotate the first movement means about a longitudinal axis thereof.

In a $16^{th}$ aspect according to any one of aspects 13 to 15, the second member comprises second actuator configured to act upon the second movement means in order to position the seating. Optionally, the second movement means are operably coupled to the seat holder so that the second movement means are configured to position the seating by moving the seat holder. Also optionally, the second actuator is an electric motor configured to rotate the second movement means about a longitudinal axis thereof.

In a $17^{th}$ aspect according to the $16^{th}$ aspect, the first movement means comprises a first threaded control rod, axially fixed to the first member, so that the first threaded control rod can be rotated about a longitudinal axis thereof without executing a translatory movement. The first threaded control rod is further rotatably engaged with the support or seat holder, thereby being configured to move the support or the seat holder between and into the plurality of positions upon rotation of the first threaded control rod.

In an $18^{th}$ aspect according to any one of the preceding aspects, the second movement means comprises a second threaded control rod, axially fixed to the second member, so that the control rod can be rotated about a longitudinal axis thereof without executing a translatory movement. The second threaded control rod is further rotatably engaged with the support or the seat holder, thereby being configured to move the support or the seat holder between and into the respective plurality of positions upon rotation of the second threaded control rod.

In a $19^{th}$ aspect according to the $18^{th}$ aspect, the control unit is configured to synchronize a movement of first and second actuating means so that the cutting means are positioned opposite of the seat.

In a $20^{th}$ aspect according to any one of aspects 7 to 16, the first and/or second movement means comprise one of a push rod assembly and a pneumatic or hydraulic actuator or a linear motor operably coupled to a linear rack. The first and/or second movement means are operably coupled to the control unit and the control unit is configured to control the first and/or second movement means.

In a $21^{st}$ aspect according to any one of aspects 7 to 16, the first and/or second movement means comprise a lock/unlock mechanism configured to lock a current position of the support and the seat holder in one of a plurality of discrete locking positions along a length of the first and/or second member, respectively.

In a $22^{nd}$ aspect according to the $21^{st}$ aspect, the lock/unlock mechanism is configured to be manually adjustable.

In a $23^{rd}$ aspect according to any one of the preceding aspects, the first member comprises a first track configured for receiving either the support or the seat holder. The first track has a shape of a continuous cavity extending along a length of the first member.

In a $24^{th}$ aspect according to the $23^{rd}$ aspect, the support or the seat holder at least partially occupies the first track, thereby defining one or more regions, adjacent to the support or the seat holder.

In a $25^{th}$ aspect according to the $24^{th}$ aspect, the first member comprises at least one cover, configured for covering the one or more regions. Optionally, the cover comprises at least one roller carried by the first member in correspondence of the one or more regions and configured to adapt to a size of the one or more regions by releasing or retracting a rolled-up cover. Also optionally, the at least one roller is rotatably coupled to the support or the seat, and an end of the rolled-up cover is coupled to the abutment element.

In a $26^{th}$ aspect according to any one of the preceding aspects, the second member comprises a second track configured for receiving either the support or the seat holder. The second track has a shape of a continuous cavity extending along a length of the second member.

In a $27^{th}$ aspect according to the $26^{th}$ aspect, the support or the seat holder at least partially occupies the second track, thereby defining one or more regions adjacent to the support or the seat holder (323).

In a 28$^{th}$ aspect according to the 27$^{th}$ aspect, the second member comprises at least one cover, configured for covering the one or more regions. Optionally, the cover comprises at least one roller carried by the second member in correspondence of the one or more regions and configured to adapt to a size of the one or more regions by releasing or retracting a rolled-up cover. Also optionally, the at least one roller is rotatably coupled to the support or the seat, and an end of the rolled-up cover is coupled to the abutment element.

In a 29$^{th}$ aspect according to any one of the preceding aspects, the elongated blade is configured to cut the film. Optionally, the elongated blade is configured to cut the film substantially perpendicularly to a moving direction thereof.

In a 30$^{th}$ aspect according to any one of the preceding aspects, the cutting means are configured to provide the film with an incision, and are adjustably mounted to the respective member so that the incision can be provided at a predetermined angle. Optionally, the angle is comprised between 30° and 60° with respect to a longitudinal extension of the respective member.

In a 31$^{st}$ aspect according to any one of the preceding aspects, the members are arranged with respect to each other so that the first working surface and the second working surface are positioned parallel to and facing one another.

According to a 32$^{nd}$ aspect of the invention, there is provided a packaging apparatus, comprising a control unit, a loading station configured to position a tubular film around a product to be packaged, and a sealing station coupled to the control unit. The control unit is configured to control the sealing station to create one or more seals on the tubular film. Further, the apparatus comprises an output station and a means for moving the products from the loading station towards and through the sealing station and towards the output station. The sealing station comprises a device for sealing and cutting according to any one of the preceding aspects.

In a 33$^{rd}$ aspect according to the 32$^{nd}$ aspect, the apparatus further comprises evacuation means and the control unit is configured to control the sealing station to create a first seal on the tubular film, thereby forming a first sealed end and creating a semi-sealed package containing the product to be packaged. The semi-sealed package has a second open end. The evacuation means are coupled to the control unit and the control unit is configured to expel gas present within the semi-sealed package. The means for moving are configured to move the semi-sealed package, the means for moving being coupled to the control unit, the control unit being configured to control the means for moving to move the semi-sealed package. The control unit is further configured to control the sealing station to create a second seal on the tubular film, thereby sealing the second open end, forming a second sealed end spaced apart from the first sealed end, and creating a sealed package containing the product to be packaged.

According to a 34$^{th}$ aspect of the invention, there is provided a process for sealing and cutting in a packaging apparatus optionally comprising the device of any one of aspects 1 to 32 or the apparatus of aspect 33. The process comprises the steps of creating a first seal on a tubular film, thereby creating a semi-sealed package, and creating a second seal on the semi-sealed package, thereby creating a sealed package, and creating a substantially transversal cut in the tubular film, thereby separating the semi-sealed package or the sealed package from a subsequent portion of the tubular film. The step of creating the first or second seal comprises creating an incision in a section of the first or second seal, the incision defining a pre-determined breaking zone in the tubular film of the sealed package.

In a 35$^{th}$ aspect according to the 34$^{th}$ aspect, the process further comprises modifying a position and/or an orientation of a cutting means in order to configure a length, a position, and/or an orientation of the incision in the first seal of the sealed package, thereby facilitating breaking of the second seal and/or rupture of the film along the pre-determined breaking zone of the sealed package upon pulling the film apart on either side of the pre-determined breaking zone.

In a 36$^{th}$ aspect according to any one of aspects 34 and 35, the steps of creating the first seal, creating the second seal, and cutting the tubular film are carried out substantially at the same time.

In a 37$^{th}$ aspect according to any one of aspects 34 to 36, the process further comprises the steps of positioning a product in a film and sealing the film along a longitudinal edge thereof in order to obtain the product placed inside a portion of the tubular film.

Advantages of the sealing and cutting device, the packaging apparatus comprising the device, and the packaging process include that a seal can be formed in a package, in which a pre-defined rupture zone has an adjustable size and/or position. The individual properties of the seal and/or the pre-defined rupture zone can be easily modified depending upon a number of factors, including type, size, shape, weight, composition, shelf or storage life, etc. of product to be packaged. The individual properties of the seal and/or the pre-defined rupture zone can further be easily modified in a production environment and do not require any extensive modifications to the packaging apparatus. In particular, disassembly and re-assembly of components and/or replacement thereof due to desired modifications can be minimized or entirely avoided.

DETAILED DESCRIPTION

Figure 1A:
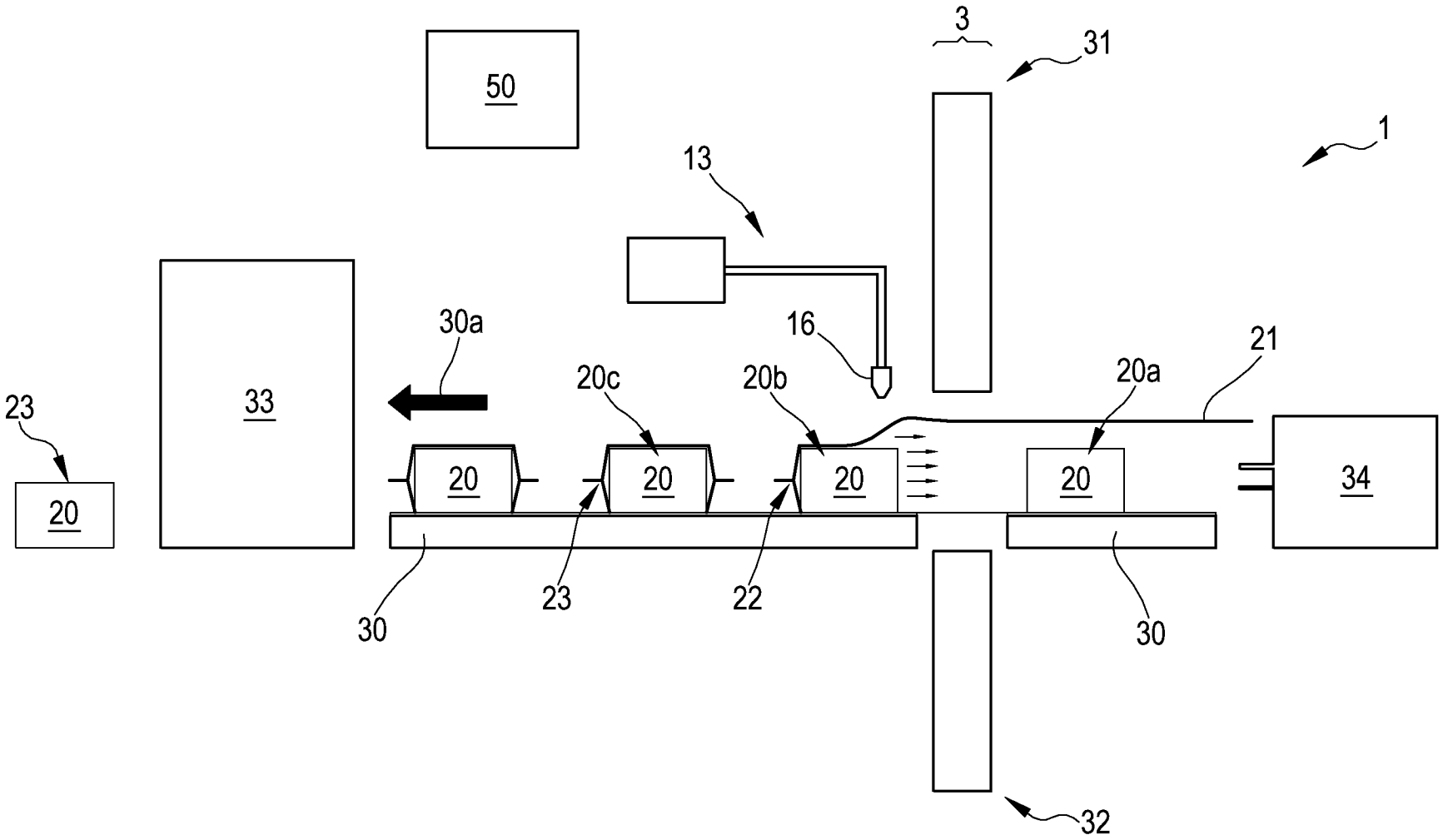
FIG. 1A depicts a first embodiment of a packaging apparatus according to the present invention.
Figure 1B:
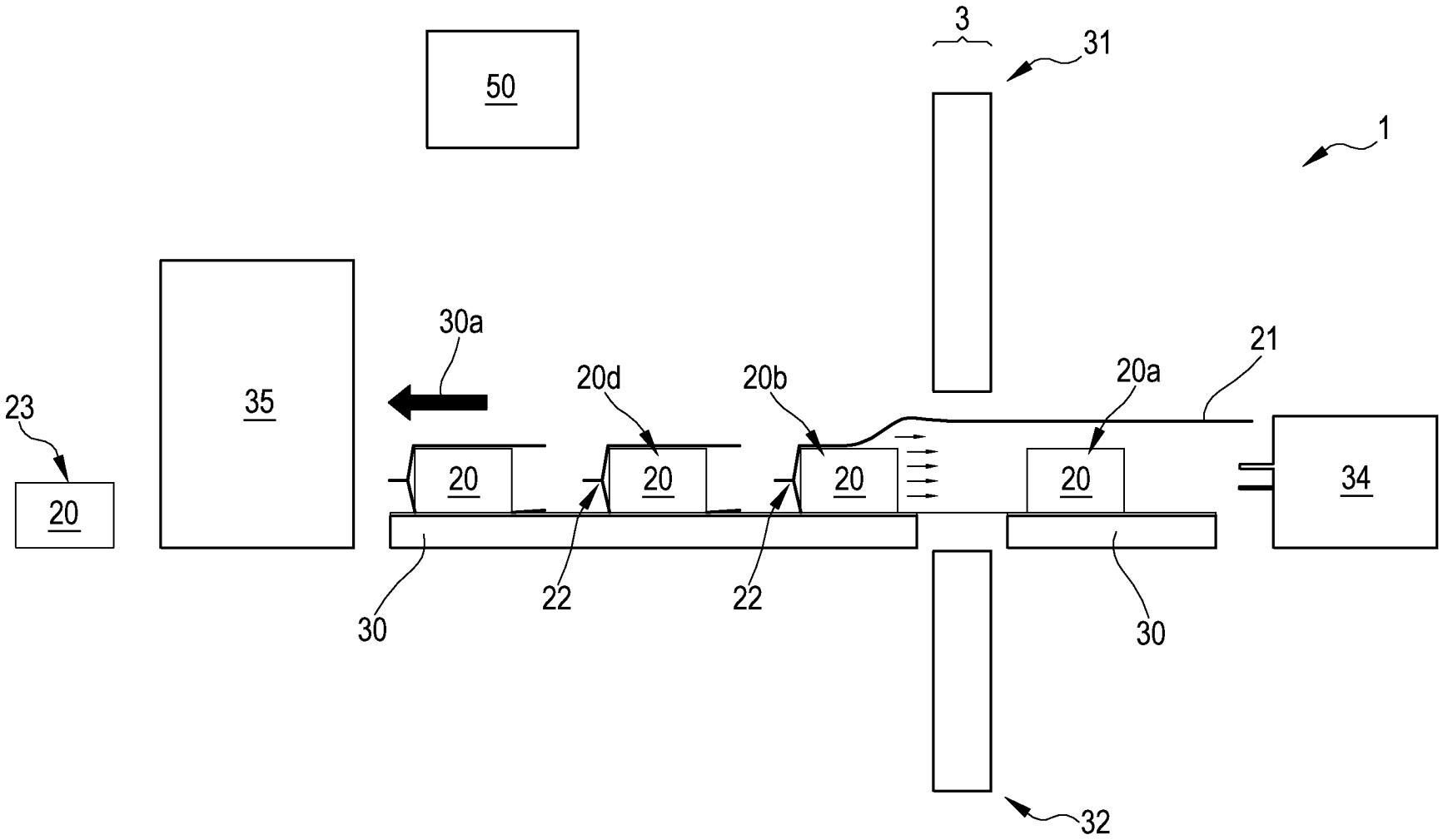
FIG. 1B depicts a second embodiment of a packaging apparatus according to the present invention.

FIGS. 1A and 1B depict first and second embodiments of a packaging apparatus according to the present invention. The following description pertains to both embodiments unless specifically FIG. 1A or FIG. 1B is referred to. In FIGS. 1A and 1B, identical elements have the same reference numerals. In general, the packaging apparatus 1 comprises a loading station (not shown), a sealing station 3, a means for evacuating 13, and means for moving 30.

With respect to both the first and second embodiment shown in FIGS. 1A and 1B, the means for moving 30 are configured to move product 20 situated inside film 21 from the loading station towards and through the sealing station 3 and along the means for evacuating 13.

Generally, reference is made to FIG. 1A, while elements specific to the embodiment shown in FIG. 1B are described with specific reference to the latter.

With respect to FIG. 1A, while product 20 is being moved, the means for evacuating 13 expels air or gas contained inside tubular film 21 and around product 20 from the semi-sealed package 22 containing product 20. The expulsion of gas from inside the package can be achieved in a one-pass manner, where the semi-packaged product passes underneath the air curtain and the gas inside the semi-sealed package is expelled from the sealed end to the open end of the semi-sealed package.

The product to be packaged 20 can assume different states (20*a*, 20*b*, 20*c*) of being packaged. States 20*a*, 20*b*, 20*c* denote product 20 being in different packaging stages. For example, state 20*a* denotes product 20 positioned inside tubular film 21, state 20*b* denotes semi-packaged product 20, and state 20*c* denotes packaged product 20.

In state 20*a*, a film 21 is positioned around product 20 or product 20 is positioned in a tubular film 21. Alternatively, in state 20*a* product 20 is positioned on film 21, which is subsequently folded over and sealed at its longitudinal edges in order to form a tubular film 21. This can be carried out at the loading station.

The sealing station 3 comprises an upper sealing and cutting member 31 and a lower sealing and cutting member 32 configured to seal and cut the packaging. Sealing and cutting members 31 and 32 are configured to create a first seal on film 21, thereby creating a semi-sealed package 22 containing product 20 in state 20*b*. Product 20 in state 20*b* is situated inside film 21 and semi-sealed package 22 comprises a sealed end and an open end. The open end can be situated opposite the sealed end.

Sealing and cutting members 31 and 32 are further configured to create a second seal on film 21, thereby creating a sealed package 23. In state 20*c*, product 20 is situated inside film 21 and sealed package 23 comprises a first sealed end and a second sealed end. The first and second sealed ends can be situated opposite each other.

Sealing and cutting members 31 and 32 can be configured to create both seals at once. For example, sealing and cutting members 31 and 32 can create the second seal of a first product and the first seal of a second (upstream) product at substantially the same time, so that subsequently the first product is contained in a sealed package and the second product is contained in a semi-sealed package.

With respect to FIG. 1B, sealing and cutting members 31 and 32 are configured to create a first seal on film 21, thereby creating a semi-sealed package 22 containing product 20 in state 20*b*. Product 20 in state 20*b* is situated inside film 21 and semi-sealed package 22 comprises a sealed end and an open end. The open end can be situated opposite the sealed end. In contrast to the embodiment shown in FIG. 1A, the sealing and cutting members 31 and 32 simultaneously or subsequently cut the film 21 without immediately creating the second seal. For example, the sealing and cutting members 31 and 32 can be configured to cut the film 21 while creating the first seal on a subsequent semi-sealed package 22, so that, as shown in FIG. 1B, one semi-sealed package 22 in state 20*d* is separated from a subsequent semi-sealed package 22 in state 20*b*. Therefore, contrary to the embodiment shown in FIG. 1A, means for moving 30 move semi-sealed packages 22 (and not sealed packages 23) towards vacuum and sealing station 35.

With respect to both FIGS. 1A and 1B, for sealing and/or cutting, the sealing and cutting members 31 and 32 are brought from a first configuration, in which the members 31 and 32 are spaced apart from one another, into a second configuration, in which the members 31 and 32 are substantially in contact with one another. Within the scope of this document, two elements being substantially in contact with each other is understood to include the two elements being in close proximity with each other, possibly separated only by one or more layers of film (e.g. film 21), so that the film can be interposed between the two elements entirely or in part (e.g. completely or partly covering the contact surface or surfaces).

In order to facilitate sealing and/or cutting film 21, sealing and cutting members 31 and 32 are arranged so that film 21 is interposed between members 31 and 32. Members 31 and 32 can have active or working surfaces that are configured to face film 21 and each other in a manner that film 21 is, in the second configuration of members 31 and 32, substantially in contact with both working surfaces. Further, where no film 21 is interposed between members 31 and 32, members 31 and 32 are substantially in contact with each other, wherein contact can be made by means of the active or working surfaces of both members 31 and 32.

During sealing and/or cutting, film holders 311, 316, 321, and 326 are configured to hold film 21 such that its position with respect to members 31 and 32 is fixed. Sealing bars 312, 322, 314, and/or 324 are configured to effect sealing or otherwise bonding of the two or more layers of film 21. In one example, sealing of film 21 is achieved by heat treatment of film 21 through sealing bars 312 and/or 314. Cutting bar 315 is configured to create a transversal or perpendicular cut in film 21. In one example, cutting bar comprises a blade extending along a length of member 31, wherein the corresponding cutting bar 325 of member 32 comprises a seat 325*a* configured to receive the blade upon contact between members 31 and 32.

Figure 2:
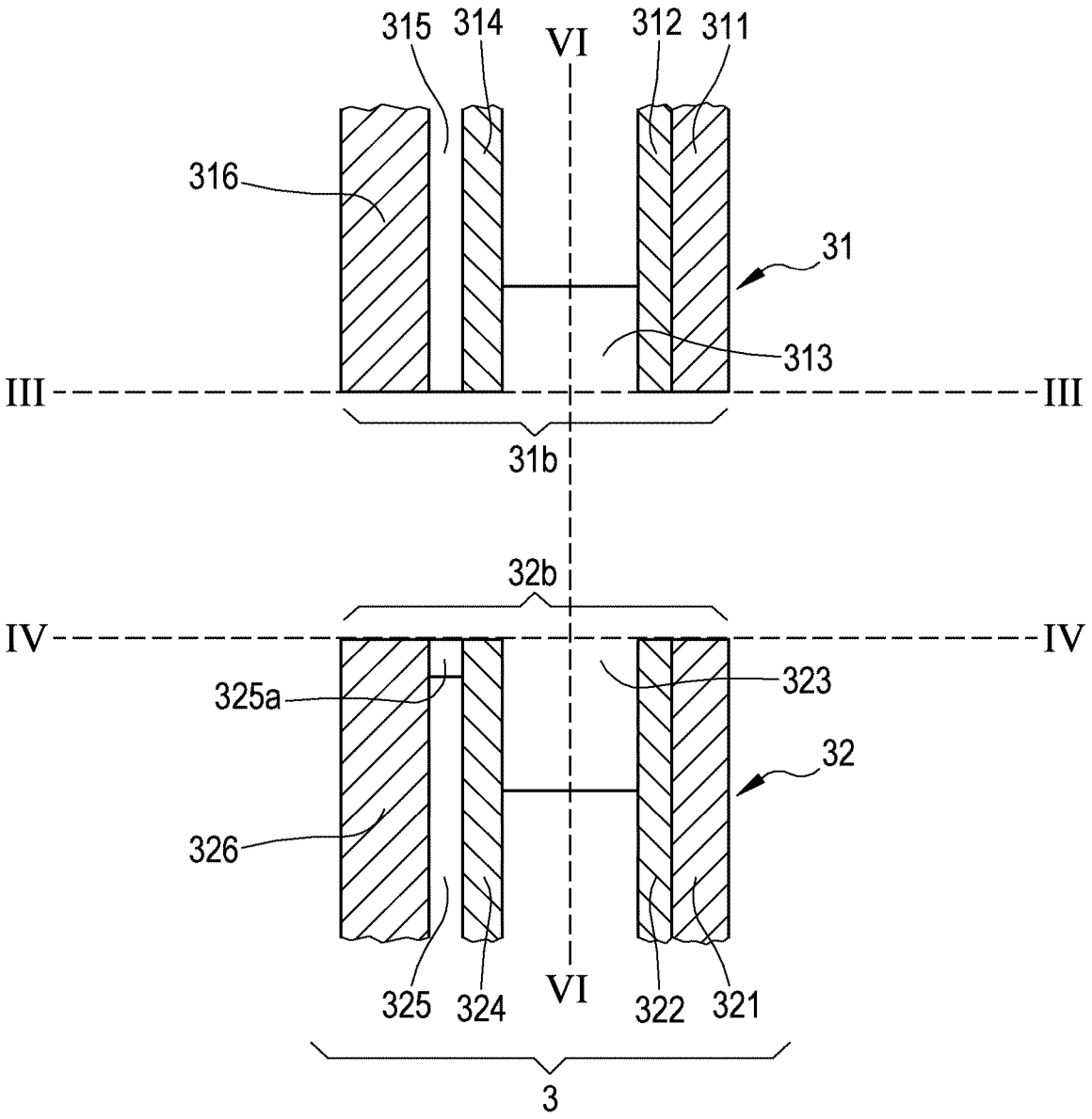
FIG. 2 shows a cross-section view of a first embodiment of sealing and cutting members 31 and 32 in accordance with the present invention.
Figure 3:
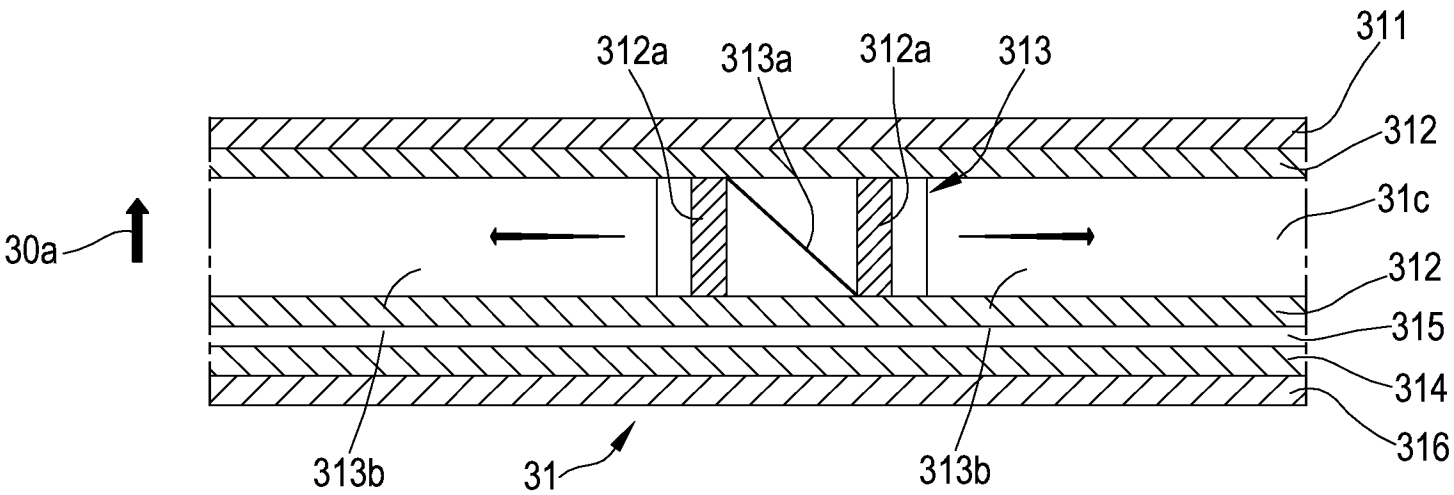
FIG. 3 shows a bottom-up view of the first embodiment of the upper sealing and cutting member 31 in accordance with the present invention, along plane shown in FIG. 2.
Figure 4:
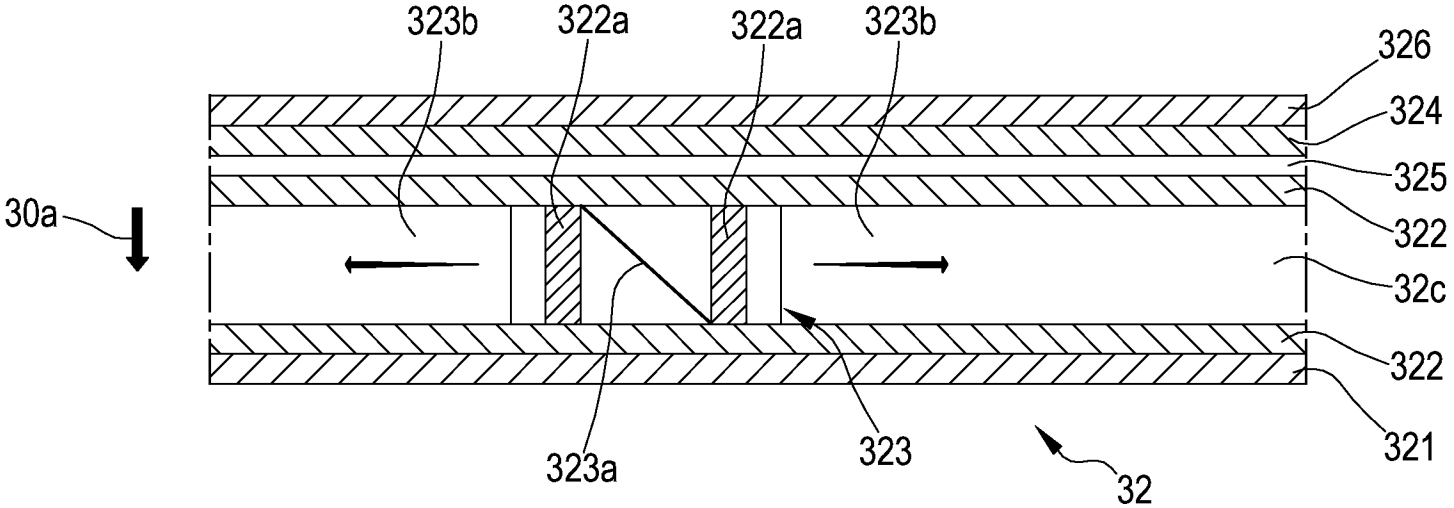
FIG. 4 shows a top-down view of the first embodiment of the lower sealing and cutting member 32 in accordance with the present invention, along plane IV-IV shown in FIG. 2.

Sealing and cutting members 31 and 32 can comprise one or more sealing bars 312, 314, 322, and 324 (see for example FIGS. 2, 3, and 4). Sealing and cutting members 31 and 32 can further be configured to form a transversal seal in the packaging. A transversal seal denotes a seal oriented substantially transversal to a longitudinal extension of film 21 and to the direction of movement of the products. In the case of the packaging being supplied from a roll of film 21, the sealing and cutting members 31 and 32 can form a transversal seal across the tube of film 21, substantially perpendicular to the length of film 21.

In the first embodiment shown in FIG. 1A, the means for moving 30 are configured to create relative motion between product 20 and outlet 16. For example, the means for moving 30 are configured to move product 20 through states 20*a*, 20*b*, and 20*c*, such that product 20 is moved from the loading station towards and through the sealing station 3 and towards and through the air curtain created below outlet 16. When the product 20 is in state 20*c* (i.e. product 20 is contained in sealed package 23), the interior of the sealed package 23 is isolated from the exterior of the package. The exit belt may have a plurality of distributed holes in it, through which hot (or cold) air may be injected to increase or intensify the air expulsion around product 20. This injection of air is especially advantageous if product 20 is of irregular shape and/or is not being supported by a tray.

The means for evacuating 13 can comprise a gas blower connected to an outlet and configured to supply a flow of gas to and/or through the outlet. For example, the outlet can be configured to direct the gas flow supplied by the gas blower towards the semi-sealed package 22 as product 20 moves along from state 20*a* to state 20*b* and state 20*c*.

The gas blower can be configured to supply a gas flow in a manner substantially continuous over time. For example, the gas blower can supply a constant gas flow. The gas blower can further be configured to supply a gas flow varying over time in pressure and/or volume. The gas blower can create a gas flow with high volume and low pressure. This can be defined in relation to a compressor, which creates a gas flow with low volume and high pressure.

In the second embodiment shown in FIG. 1B, the means for moving 30 are, similarly, configured for moving the products along the packaging apparatus from the sealing and cutting members 31 and 32 towards the vacuum and sealing station 35. Here, there is no need for the use of an air curtain because of the use of a separate vacuum and sealing station 35, which serves to subsequently vacuumize and seal the semi-sealed packages 23 in state 20*d*. The means for moving can comprise one or more conveyor belts. In particular, the means for moving 30 can comprise a conveyor belt, for example an exit belt.

With respect to both the first and second embodiment shown in FIGS. 1A and 1B, the packaging apparatus 1 further comprises a control unit 50. The control unit is connected (connections not shown for reasons of clarity) to one or more components of the packaging apparatus 1, including the loading station, the sealing station 3, the sealing and cutting members 31 and 32, the means for moving 30, the means for evacuating 13, and a flusher 34. The flusher 34 can be provided in order to flush the inside of the packaging film 21 with an inert or other gas or mixture of gases.

In case of the second embodiment shown in FIG. 1B, the control unit 50 is further connected to a vacuum and sealing station 35, where the semi-packaged products in state 20*d* are vacuumized and sealed. In case of the first embodiment shown in FIG. 1A, the control unit 50 is further connected to a hot air or shrink tunnel 33, where the film 21 of packaged products 20 in state 20*c* is shrinked after having been sealed. It is noted that the vacuum and sealing station 35 can comprise any means for vacuumization known in the art.

With respect to both embodiments again, for reasons of clarity, FIGS. 1A and 1B do not show individual connection lines between the control unit 50 and other components. It is understood that the packaging apparatus 1 can comprise common connection means for connecting control unit 50 to other components, for example electrical, optical, or other connections and/or leads.

The control unit 50 can be configured for commanding the transport of products 20 along a predefined path, e.g. by controlling a motor comprised in means for moving 30 according to a step-by-step motion or according to a continuous motion. The control unit can also command actuators of different components as described below, for example, in order to create transverse seals on the tubular film.

The control unit can comprise a digital processor (CPU) with memory (or memories), an analogical type circuit, or a combination of one or more digital processing units with one or more analogical processing circuits. In the present description and in the claims it is indicated that the control unit is "configured" or "programmed" to execute certain steps. This may be achieved in practice by any means, which allow for configuring or programming the control unit. For instance, in case of a control unit comprising one or more CPUs, one or more programs are stored in an appropriate memory. The program or programs contain instructions, which, when executed by the control unit, cause the control unit to execute the steps described and/or claimed in connection with the control unit. Alternatively, if the control unit is of an analogical type, then the circuitry of the control unit is designed to include circuitry configured, in use, to process electric signals such as to execute the control unit steps herein disclosed.

The control unit 50 can be connected to the means for evacuating 13 and be configured to send and/or receive control signals to/from the means for evacuating 13. The control unit 50 can further be configured to control the means for evacuating 13 to supply a constant or a variable gas flow to the outlet. To this aim, the control unit can be configured to control a power driving the gas blower comprising the means for evacuating 13 and/or to control one or more valves controlling the gas flow towards the outlet.

The control unit 50 can be configured to control the means for moving 30. For example, the control unit 50 can be configured to increase and decrease an operating speed of the means for moving 30. The control unit 50 can further be configured to control the operating speed of the means for moving 30 depending on a position of products 20 with respect different components of the packaging apparatus 1 (e.g., in the first embodiment with respect to the outlet 16 and/or the air curtain).

The control unit 50 can additionally or alternatively be configured for controlling the sealing and cutting members 31 and 32. The control unit 50 can further be configured to control the sealing and cutting members 31 and 32 depending on a position of products 20 with respect to the means for evacuating and/or the sealing and cutting members 31 and 32. For example, the control unit 50 can be configured to activate the sealing and cutting members 31 and 32 depending on a position of products 20 and/or tubular film 21 with respect to the outlet and/or sealing and cutting members 31 and 32.

In particular, in another aspect, the control unit 50 can be configured to control one or more components depending on signals sent to and/or received from other components. For example, the control unit 50 can be configured to control an activation of one or more components depending on the position of products 20 and/or tubular film 21 with respect to other components of packaging apparatus 1. This way, the control unit 50 can activate, for example, the sealing and cutting members 31 and 32 when one product 20 is in state 20*a* and another product 20 is in state 20*b* (or state 20*d*), such that between the two products 20 the first and second seals are created on the film 21, respectively.

In the first embodiment shown in FIG. 1A, when the air inside the semi-sealed package 22 has been expelled, sealing and cutting members 31 and 32 create the second seal at the open end of semi-sealed package 22, thereby creating sealed package 23 containing product 20. Sealing and cutting members 31 and 32 can, during the same operation, create the first sealed end for the packaging of the subsequent product 20, which is in state 20*a*, situated inside tubular film 21, upstream of now sealed package 23, thereby creating a semi-sealed package 22 for the subsequent product 20.

In the second embodiment shown in FIG. 1B, sealing and cutting members 31 and 32 do not create the second seal at the open end of semi-sealed package 22, thereby leaving semi-sealed package 22 in state 20*d*, i.e. semi sealed and containing product 20. Sealing and cutting members 31 and 32 can, during the same operation, create the first sealed end for the packaging of the subsequent product 20, which is in state 20*a*, situated inside tubular film 21, upstream of the previous semi-sealed package 22 in state 20*d*, and cut the semi-sealed package 22 in state 20*d* from the semi-sealed package 22 in state 20*b*, thereby separating the two semi-sealed packages 22 and sealing the package 22 in state 20*b* in one operation.

With respect to both the first and second embodiment shown in FIGS. 1A and 1B, the means for moving 30 can comprise one or more conveyor belts 30. The one or more conveyor belts are configured to transport the products 20 in states 20*a*, 20*b*, and 20*c* (or 20*d*), for example as packages 22 and 23, along a pre-defined path through the packaging apparatus 1. For example, the packaging apparatus comprises at least two conveyor belts 30 as shown in FIGS. 1A and 1B. A first conveyor belt 30 is configured to transport the product 20 and/or film 21 upstream of the sealing and cutting members 31 and 32. A second conveyor belt 30 is configured to transport the product 20 and/or packages 22 and/or 23 downstream of the sealing and cutting members 31 and 32.

The sealing and cutting members 31 and 32 can further be configured to separate the semi-sealed packages 22 from the sealed packages 23 when forming the first and second seals (in case of FIG. 1A), or to separate the semi-sealed packages 22 in state 20*b* from the semi-sealed packages 22 in state 20*d* when forming the second seal (in case of FIG. 1B). As shown in FIGS. 1A and 1B, the sealing station 3 includes sealing and cutting members 31 and 32 and a separation of packages 22 and/or 23 is effected substantially at the same time when sealing the packages 22 and/or 23.

In the first embodiment shown in FIG. 1A, the packaging apparatus 1 can comprise a separate cutter (not shown), in which case the sealing and cutting members 31 and 32 are configured to create a connection zone in an area where subsequent packaged products 23 are connected to each other by means of film 21, while the separate cutter is configured to cut the packaging material in order to separate the packaged products. For example, the separate cutter may cut the tube of film 21 once the package 23 has been sealed. The separate cutter may be positioned adjacent the sealing and cutting members 31 and 32. In particular, the separate cutter may be disposed near to sealing and cutting members 31 and 32 such that the sealing and cutting members 31 and 32 seal the only open end of one package 22 (after gas has been expelled from that package), and/or seal the opposite end of a subsequent package 23, and/or provide a pre-defined rupture zone, whereas the cutter 32 separates the two packages 22 substantially simultaneously or subsequently. Alternatively, the separate cutter may be positioned further downstream so as to separate the packages 22 after they have been completely sealed. The separate cutter can comprise two parts above and below the conveyor belts 30.

FIG. 2 shows a cross-section view of a first embodiment of sealing and cutting members 31 and 32 in accordance with the present invention. Sealing and cutting members 31 and 32 of sealing station 3 comprise corresponding upper sealing and cutting member 31 and lower sealing and cutting member 32. Sealing and cutting members 31 and 32 are arranged mutually opposite to one another and are attached to actuating means 310 (not shown) such that either one or both members 31 and/or 32 can be moved with respect to one another at least from a first position, where members 31 and 32 are in a spaced-apart configuration to at least a second position, where members 31 and 32 are substantially in contact to one another.

For reasons of clarity, upper sealing and cutting member 31 is also referred to as member 31, lower sealing and cutting member 32 is also referred to as member 32. Sizes and/or arrangement of individual components of members 31 and/or 32 are not shown to scale and can be adapted to individual requirements. For example, cutters and/or sealing bars can be bigger or smaller depending upon the material of film 21.

Member 31 comprises a first film holder 311, a first sealing bar 312, a knife support 313, a second sealing bar 314, a cutting bar 315, and a second film holder 316. Preferably, the first film holder 311, the first sealing bar 312, the knife support 313, the second sealing bar 314, the cutting bar 315, and the second film holder 316 are arranged within member 31 in this order. Member 32 comprises a first film holder 321, a first sealing bar 322, a knife seat 323, a second sealing bar 324, a cutting bar 325, and a second film holder 326, arranged mutually opposite corresponding elements of member 31 such that, for example, first film holder 321 of member 32 is arranged opposite first film holder 311 of member 31. Further, first sealing bar 322 of member 32 is arranged opposite first sealing bar 312 of member 31.

The film holders 311 and 316 of member 31 are configured to interact with corresponding counterparts, namely film holders 321 and 326 of member 32, such that when members 31 and 32 are brought substantially in contact with each other, film 21 (not shown) of products to be packaged is contacted and squeezed between film holders 311, 321, 316, and 326, and thereby substantially immobilized with respect to members 31 and 32. This holding action serves to fix the film 21 with respect to members 31 and 32 in order to facilitate, for example, precise and defined cutting and sealing of the film.

In a similar manner, sealing bars 312 and 314 of member 31 are configured to interact with corresponding counterparts, namely sealing bars 322 and 324 of member 32, such that when members 31 and 32 are brought substantially in contact with each other, film 21 (not shown) of products to be packaged is contacted and squeezed between sealing bars 312 and 314, 322, and 324, thereby facilitating sealing of two adjacent layers of film 21. The sealing can be achieved, for example, by subjecting the film in the areas affected by sealing bars 312, 314, 322, and 324 to heat treatment. In this embodiment, sealing bars 312, 314, 322, and 324 can be heated, for example electrically, to a temperature sufficient for sealingly bonding (e.g. welding) or otherwise connecting the two layers of film 21 to one another.

In a similar manner, cutting bar 315 of member 31 is configured to interact with a corresponding counterpart, namely cutting bar 325 of member 32, such that when members 31 and 32 are brought substantially in contact with each other, film 21 (not shown) of products to be packaged is contacted and cut by cutting bars 315 and 325, thereby facilitating cutting of film 21 and, thus, separating for example a semi-packaged product from a packaged product. The cutting can be achieved, for example, by bringing cutting bars 315 and 325 substantially into contact, whereby both cutting bars act upon one another in a manner similar to the blades of a pair of scissors. In alternative embodiments, cutting bar 325 can additionally or alternatively comprise a seat 325*a* corresponding to cutting bar 315, such that upon contact of cutting bar 315 with seat 325*a* of cutting bar 325, the film 21 is cut.

FIG. 3 shows a bottom-up view of the first embodiment of the upper sealing and cutting member 31 in accordance with the present invention, along plane III-III shown in FIG. 2. Film holders 311 and 316, as well as sealing and cutting bars 312, 314, and 315 are of elongated shape and extend substantially parallel to one another in a direction substantially perpendicular to a direction of movement of products 20, thereby facilitating providing the film with the aforementioned seals developing substantially transversal to a direction of movement of products 20. Members 31 and 32 can be shaped and/or arranged differently if it is desired to alter the shape, position and/or orientation of the cuts and/or seals provided by members 31 and 32.

A knife support 313 is positioned between the sealing bars 312 and 314 and movably coupled to member 31 such that knife support 313 is movable along a direction substantially parallel to the longitudinal extension of member 31 from a first end-run position located at a first end of member 31 to a second end-run position located at an opposite second end of member 31. The first and second end-run positions are the outermost positions that knife support 313 can assume in the respective direction, when moving along member 31. Further, knife support 313 can be releasably fixed in a plurality of intermediate positions between and including the first and second end-run positions. In this manner, knife support 31 can be laterally moved in a position suitable for providing the packaging film 21 with a cut defining a pre-determined rupture zone in the region of the seal created by members 31 and 32.

Knife support 313 is moved by lateral movement means (not shown) that are configured to impart lateral motion to knife support 313. Here, lateral motion refers to a motion direction substantially lateral to the movement direction 30*a* of products 20 if members 31 and 32 are arranged substantially perpendicular to movement direction 30*a*. Lateral movement means impart motion to knife support 313 substantially parallel to and in direction of the longitudinal extension of sealing and cutting bars 312, 314, and 315.

Lateral movement means can comprise any mechanical, electrical, hydraulic, pneumatic, or other common actuation means. For example, lateral movement means can comprise a threaded control rod extending along the length of member 31 that can be actuated by an electric motor. By rotation of the threaded control rod, and due to engagement of knife support 313 with the control rod, knife support 313 can be substantially continuously moved into virtually any position between and including the first and second end-run positions. Other actuation means can include electrical stepper motors, hydraulic actuators, pneumatic actuators, magnetic actuators, and/or combinations thereof. In some embodiments, knife support 313 can also be manually adjusted, for example by means of a common latch/unlatch mechanism that facilitates unlocking of knife support 313 to be laterally movable, manually moving knife support 313 to another position along the length of member 31, and fixing knife support 313 in the new position by locking it with respect to member 31.

Regions 313*b* extending laterally from knife support 313 are covered by adjustable cover means (not shown). The adjustable cover means adapt to a current position of knife support 313 and cover regions 313*b* on a plane substantially corresponding to a plane of a contact surface of knife support 313, the contact surface being configured to contact a corresponding contact surface of knife seat 323 of member 32 when members 31 and 32 are substantially in contact with each other.

Knife support 313 comprises a knife 313*a* that can be arranged at an angle with respect to cutting bar 315. In some examples, the angle of knife 313*a* is about 45° with respect to cutting bar 315 (and, therefore, with respect to the longitudinal extension of member 31). In other embodiments, the angle can be about 30° or 60°, or substantially any desired angle. In some embodiments, the angle of knife 313*a* can be adjustable to an angle in the range of 0° (e.g. substantially parallel to member 31) to 180° (again substantially parallel to member 31), including an angle of 90° (e.g. substantially perpendicular to member 31).

Knife 313*a* serves to provide film 21 with an incision in a region distanced from product 20 by a first seal provided by sealing bar 312 such that the incision does not compromise the sealing of product 20. The incision is sized and positioned such that it provides for a pre-determined rupture zone in the film of package 23. Examples of pre-defined rupture zones and further details are provided with respect to FIGS. 7 and 8 below.

Knife support 313 can optionally have sealing bars 312*a*. Sealing bars 312*a* (preferably in combination with sealing bars 322*a* as shown in FIG. 4) can be employed in order to provide a controlled surrounding region for incisions made by knife 313*a*. By selectively sealing regions adjacent to incisions made by knife 313*a*, the subsequent rupture process can be influenced, in particular the particular manner in which a rupture emerges and develops along the material of film 21 and starting at the incision made by knife 313*a*.

FIG. 4 shows a top-down view of the first embodiment of the lower sealing and cutting member 32 in accordance with the present invention, along plane IV-IV shown in FIG. 2. As described above, film holders 321 and 326, as well as sealing and cutting bars 322, 324, and 325 of member 32 are respective counterparts for film holders 311 and 316, as well as sealing and cutting bars 312, 314, and 315 of member 31. Members 31 and 32 are actuated by known means to be at least movable between a spaced-apart configuration that allows for the movement of products 20 into and through a region between members 31 and 32 and a closed configuration in which members 31 and 32 are substantially in contact with each other, squeezing and holding film 21 in order to effect sealing and cutting thereof.

Knife seat 323 is arranged substantially opposite knife support 313 and is actuated in a manner corresponding to the movements of knife support 313, such that whenever the position of knife support 313 is modified, the position of knife seat 323 is modified in a corresponding way in order to ensure that upon contact between members 31 and 32, knife support 313 can substantially contact knife seat 323 in a coinciding configuration (e.g. contact surfaces of knife support 313 and knife seat 323 substantially covering each other). Knife seat 323 further comprises a seating 323*a* for knife configured to receive knife 313*a* upon contact between members 31 and 32, thereby effecting the placement of an incision in film 21 as described above. The position, orientation, shape, and form of knife 313*a* and seating 323*a* are configured so as to provide for precise placement of knife 313*a* with respect to seating 323*a* in order to effect a clean cut and precise placement of the incision.

Knife seat 323 can be moved in the same manner and corresponding to movements of knife support 313 as described above. The actuating means imparting motion to knife support 313 can be the same as those imparting corresponding motion to knife seat 323. In some embodiments, each of knife support 313 and knife seat 323 are provided with separate actuating means. In such cases, the actuating means can be connected to control unit 50 in order to be controlled in a corresponding manner ensuring proper positioning of both knife support 313 and knife seat 323 with respect to each other. in case of manual adjustment of knife support 313 and/or knife seat 323, appropriate mechanical or other mechanisms can be provided in order to ensure proper positioning of both knife support 313 and knife seat 323 with respect to each other.

Regions 323*b* extending laterally from knife seat 323 are covered by adjustable cover means (not shown) in a manner similar or identical to that described with respect to regions 313*b* above. The adjustable cover means adapt to a current position of knife seat 323 and cover regions 323*b* on a plane substantially corresponding to a plane of a contact surface of knife seat 323, the contact surface being configured to contact a corresponding contact surface of knife support 313 of member 31 when members 31 and 32 are substantially in contact with each other.

Figure 5:
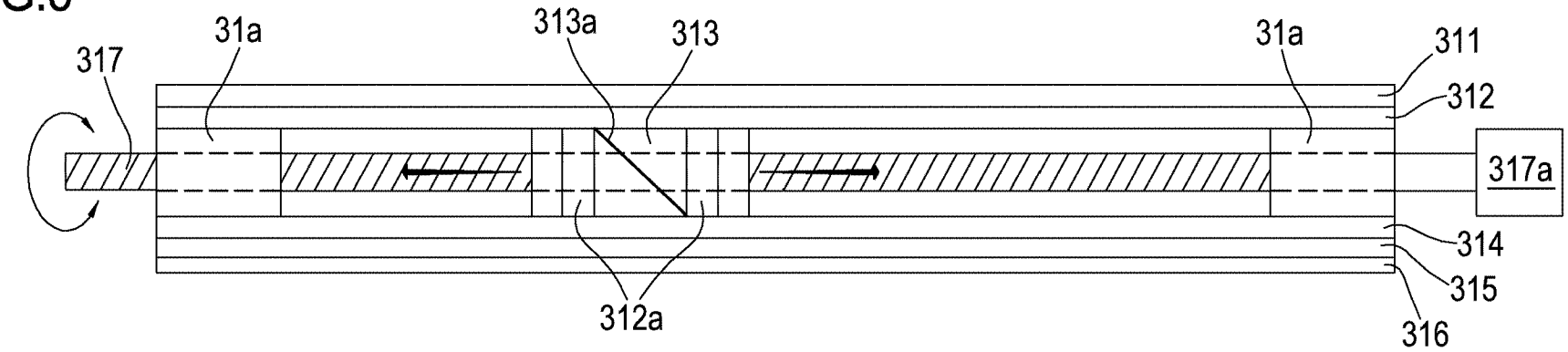
FIG. 5 shows a bottom-up view of a second embodiment of the upper sealing and cutting member 31 in accordance with the present invention, along a plane corresponding to plane shown in FIG. 2 with respect to the first embodiment.

Similar to sealing bars 312*a* as shown in FIG. 3 and as described above, knife seat 323 can optionally have sealing bars 322*a* as shown in FIG. 4. Sealing bars 322*a* operate in a manner similar to and in combination with sealing bars 312*a* as described above. Sealing bars 312*a* and 322*a* are shown in FIGS. 3, 4, and 5 in a configuration substantially perpendicular to the longitudinal extension of members 31 and 32, respectively. However, it is noted that sealing bars 312*a* and 322*a* can have a different shape, orientation, size, and/or position in order to provide the region surrounding the incision made by knife 313*a* with sealed section of a specific shape, orientation, size, and/or position, so that the desired configuration of the incision, the rupture zone, and the surrounding portion of the package can be achieved (see also FIGS. 7A, 7B, 8A, 8B, and 8C).

FIG. 5 shows a bottom-up view of a second embodiment of the upper sealing and cutting member 31 in accordance with the present invention, along a plane corresponding to plane shown in FIG. 2 with respect to the first embodiment. In this embodiment, member 31 is provided with a threaded control rod 317, rotatably coupled to bearings 31*a* of member 31. The coupling of control rod 317 with bearings 31*a* allows for a rotating motion of control 317 about its longitudinal axis, whereas the threaded surface of control rod 317 is not in engagement with any part of bearings 31*a* and/or member 31 such that rotation of control rod 317 does not impart any other motion to control rod 317 except rotation.

Knife support 313, however, is slidably coupled to member 31 such that knife support 313 can move along member 31 between bearings 31*a* and further comprises a coupling element in engagement with the threaded surface of control rod 317 such that rotation of control rod 317 imparts precise and controlled movement of knife support 313 along member 31. Bearings 31*a* can further serve as abutment elements, defining the first and second end-run positions for knife support 313 upon reaching a corresponding end of member 31 and abutting either one of bearings 31*a*.

Rotation of control rod 317 can be effected in any common manner as described above. If required, actuating means imparting rotation to control rod 317 can be connected to control unit 50 in order to control rotation of control rod 317 and, thus, control movement and position of knife support 313 along member 31. In an alternative embodiment similar to the second embodiment shown in FIG. 5, control rod 317 can be fixedly attached to member 31 in an immobile manner. In this case, an actuator (e.g. an electric motor) can be comprised in knife support 313 and in engagement with the threaded surface of control rod 317 such that activation of the actuator imparts motion to knife support 313 in a similar manner as described above with respect to the second embodiment shown in FIG. 5.

As already indicated, other actuating means can be applied here in order to effect the desired movement and/or adjustment of the position of knife support 313, for example, pneumatic, hydraulic, electric, and/or other. In a pneumatic system, for example, a pneumatic piston/cylinder mechanism can be coupled to knife support 313 and impart motion thereto along member 31.

Figure 6:
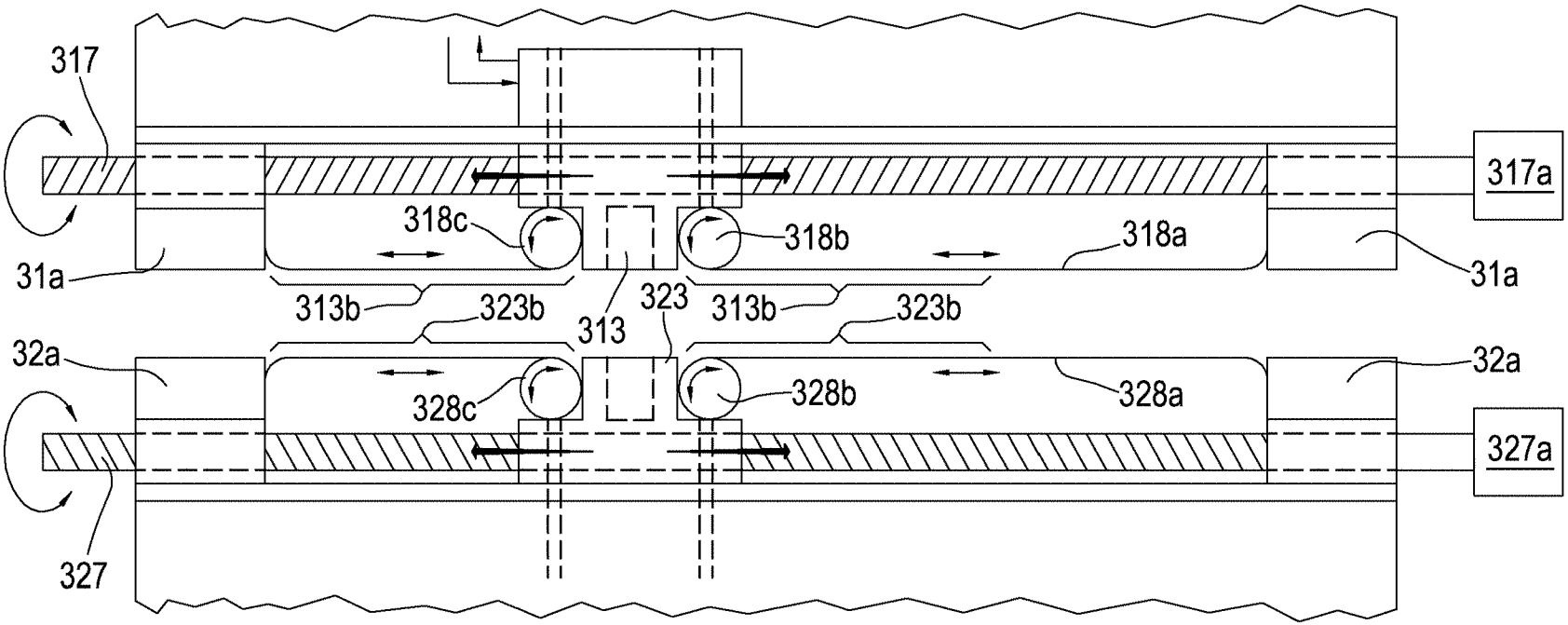
FIG. 6 shows a side view of a cross section of the second embodiment of the sealing and cutting members 31 and 32 in accordance with the present invention, along a plane corresponding to plane VI-VI shown in FIG. 2 with respect to the first embodiment.

FIG. 6 shows a side view of a cross section of the second embodiment of the sealing and cutting members 31 and 32 in accordance with the present invention, along a plane corresponding to plane VI-VI shown in FIG. 2 with respect to the first embodiment.

Regions 313*b* extending laterally from knife support 313 and regions 323*b* extending laterally from knife seat 323 are respectively covered by adjustable cover means 318*a* and 328*a*. FIG. 6 shows one example of cover means 318*a* and 328*a*, comprising metal bands attached on the outer sides of members 31 and 32 to bearings 31*a* and 32*a*, respectively. Roller means 318*b*, 328*b*, 318*c*, and 328*c* are rotatably coupled to corresponding sides of knife support 313 and knife seat 323, respectively. The adjustable cover means 318*a* and 328*a* adapt to the current position of knife support 313 and knife seat 323, respectively, and cover regions 313*b* and 323*b* on a plane substantially corresponding to a plane of the contact surfaces of knife support 313 and knife seat 323, the contact surface being configured to contact a corresponding contact surface of knife seat 323 of member 32 when members 31 and 32 are substantially in contact with each other.

As can be seen from FIG. 6, upon movement of knife support 313 to the right, roller means 318*c* will unroll a corresponding amount of metal band while roller means 318*b* will roll up a substantially same amount. Likewise, upon movement of knife seat 323 to the right, roller means 328*c* will unroll a corresponding amount of metal band while roller means 328*b* will roll up a substantially same amount. It is noted that roller means 318*b*, 318*c*, 328*b*, and 328*c* could alternatively be rotatably coupled to bearings 31*a* and 32*a*, respectively, while the ends of the metal bands are fixedly attached to knife support 313 and knife seat 323, respectively. In such a case, the mechanism would operate in substantially the same manner as described above, except for the unrolling and rolling up taking place at rolling means rotatably coupled to bearings 31*a* and 32*a*.

As indicated above, cover means 318*a* and 318*b* can have a different form and employ a different mechanism without deviating from the main principle of providing a cover for regions 313*b* and 323*b*, the size of which depends from the current position of knife support 313 and knife seat 323. For example, telescopic cover means could be employed, adapting to the position of knife support 313 and knife seat 323 by a sliding motion of a plurality of nested or interleaved cover elements. Other examples include folding elements, shifting elements, elastic elements, and/or combinations thereof.

Figure 7A:
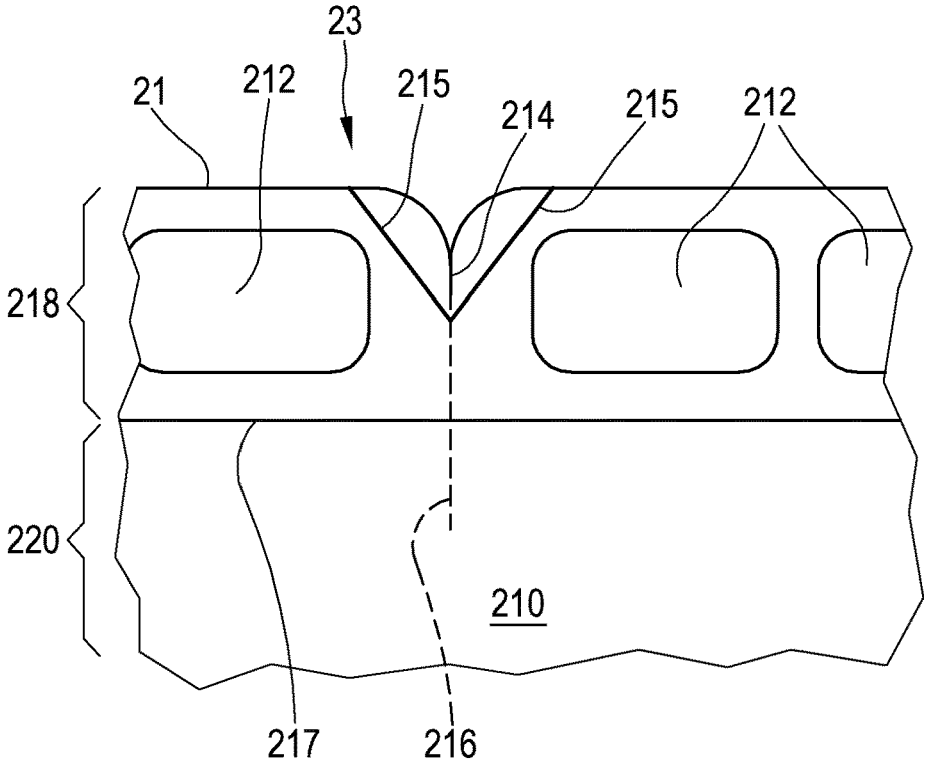
FIG. 7A shows a close-up view of a first example of a pre-defined rupture zone 214 as created with a packaging apparatus in accordance with the present invention.

FIG. 7A shows a close-up view of a first example of an incision 214 and pre-defined rupture zone 216 as created with a packaging apparatus in accordance with the present invention.

The package 32 of a product 20 is made up of film 21 and comprises a main portion 220 and a sealing portion 218. The sealing portion 218 comprises a pre-defined rupture zone 216 extending towards and, upon activation, into main portion 220. A transversal seal 217 extends between sealing portion 218 and main portion 220, sealing the contents of package 23 from the environment. The base of rupture zone 216 is defined by incision 214 provided in the border of the sealing portion 218. Sealed (e.g. welded) sections 215 further define rupture zone 216 and influence the rupturing process by directing the rupture. Here, sealed sections 215 extend in a diagonal orientation with respect to an upper edge of package 23, thereby narrowing the region, along which a rupture starting at incision 214 can develop. Air pockets 212 provide for a gripping zone, substantially extending along sealing portion 218.

Figure 7B:
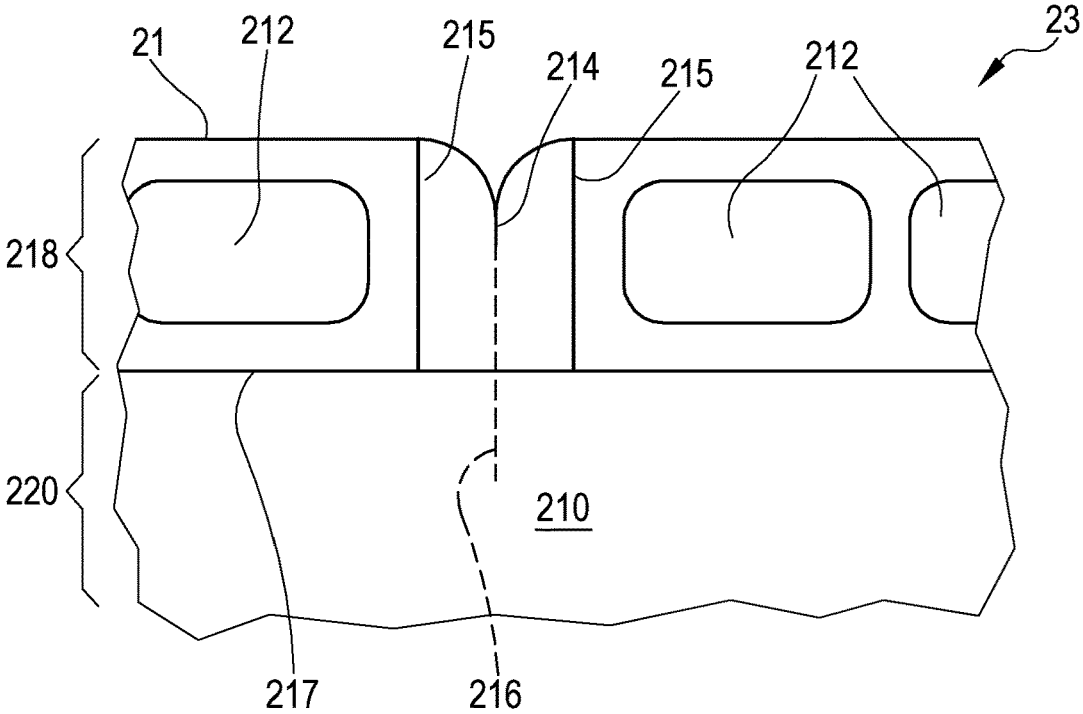
FIG. 7B shows a close-up view of a second example of a pre-defined rupture zone 214 as created with a packaging apparatus in accordance with the present invention.

FIG. 7B shows a close-up view of a second example of a pre-defined rupture zone 214 as created with a packaging apparatus in accordance with the present invention.

This second example shows a pre-defined rupture zone 216 and further elements corresponding to those shown, for example, in FIG. 7A as described above. However, in the example of FIG. 7B, sealed sections 215 extend in a substantially perpendicular orientation with respect to an upper edge of package 23. The orientation, placement, and/or position of sealed sections 215 with respect to, for example, incision 214, can be adjusted in order to modify the properties of the gripping zone, the rupture zone 216. In some examples, a larger or smaller gripping zone can be desirable, as well as a more or less constrained region along which the rupture can develop along rupture zone 216.

Figure 8A:
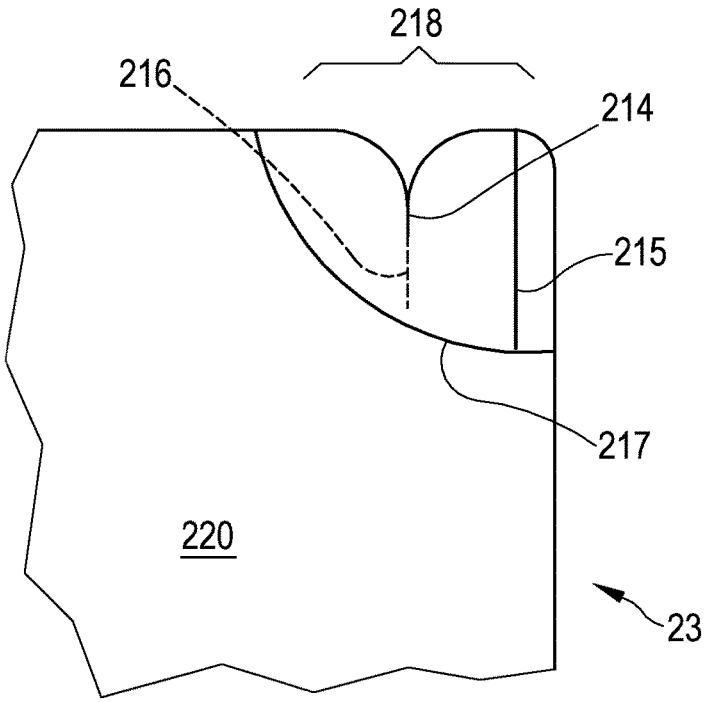
FIG. 8A shows a close-up view of a third example of a pre-defined rupture zone 214 as created with a packaging apparatus in accordance with the present invention.

FIG. 8A shows a close-up view of a third example of a pre-defined rupture zone 214 as created with a packaging apparatus in accordance with the present invention.

This third example shows a pre-defined rupture zone 216 and further elements corresponding to those shown, for example, in FIG. 7A as described above. However, in the example of FIG. 8A, the pre-defined rupture zone 216 extends close to and parallel to an edge of package 23.

Figure 8B:
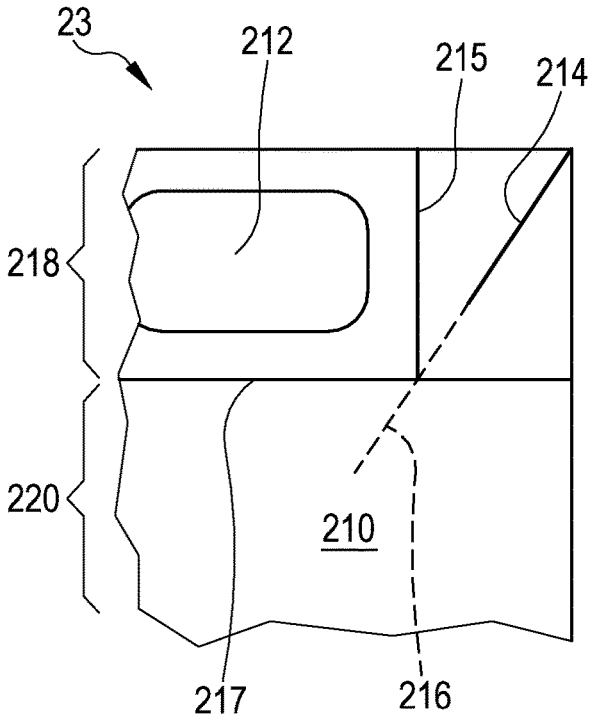
FIG. 8B shows a close-up view of a fourth example of a pre-defined rupture zone 214 as created with a packaging apparatus in accordance with the present invention.

FIG. 8B shows a close-up view of a fourth example of a pre-defined rupture zone 214 as created with a packaging apparatus in accordance with the present invention.

This fourth example shows a pre-defined rupture zone 216 and further elements corresponding to those shown, for example, in FIG. 7A as described above. However, in the example of FIG. 8B, incision 214 and pre-defined rupture zone 216 extend diagonally with respect to an edge of package 23. In this manner, for example, a package 23 can be opened in an edge-to-center fashion.

Figure 8C:
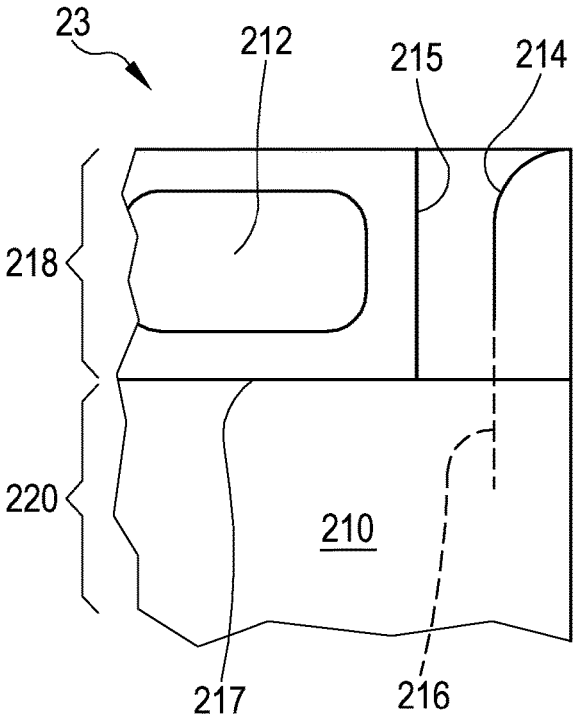
FIG. 8C shows a close-up view of a fifth example of a pre-defined rupture zone 214 as created with a packaging apparatus in accordance with the present invention.

FIG. 8C shows a close-up view of a fifth example of a pre-defined rupture zone 214 as created with a packaging apparatus in accordance with the present invention.

This fifth example shows a pre-defined rupture zone 216 and further elements corresponding to those shown, for example, in FIG. 7A as described above. However, in the example of FIG. 8C, incision 214 has an arcuate shape, starting substantially parallel to an upper edge of package 23 and terminating substantially parallel to a lateral edge of package 23 (thereby covering about a quarter segment of a circular shape). Further, pre-defined rupture zone 216 extends substantially parallel with respect to the lateral edge of package 23. In this manner, for example, a package 23 can be opened in a way that allows for removal and/or rupture of a substantial lateral portion of package 23.

With respect to the examples shown in FIGS. 7A, 7B, 8A, 8B, and 8C, it is noted that other configurations for incision 214, sealed sections 215, and rupture zone 216 (as well as those of other elements shown in these figures) are possible, depending upon, for example, the type of product to be packaged, the size of the package, the material of film 21 used for package 23, and other factors.

The packaging apparatus 1 can comprise an HFFS machine. The HFFS machine may comprise a conveyor belt 30 for supporting and transporting the packages 22, in a horizontal direction.

The product 20 may be within a package. The package 22 is unsealed when the gas is expelled from the package. The packaging may comprise a film 21. For example, the product 20 may be wrapped or partially wrapped in a film 21. The film 21 extends around the product 20. Gas is enclosed with the product 20 by the film 21.

The product 20 may be disposed on a surface. The surface may extend substantially in the horizontal direction. The surface may comprise the upper surface of a conveyor belt 30. The conveyor belt 30 may be a continuous conveyor belt 30. For example, the conveyor belt 30 may be suspended between at least two rollers. The conveyor belt 30 may transport the product 20 in a horizontal direction.

The product 20 can be disposed in a tray. The tray supports the product 20. The tray can comprise walls that extend substantially vertically from the base of the tray to a height greater than the vertical dimension of the product 20. Alternatively, the tray height may be less than or equal to the height of the product 20. The packaging extends around the tray. The tray can comprise a material selected from a list consisting of polystyrene, Aluminium, or other thermoplastic material such as PET, or cardboard. The tray can be rigid, solid or foamed, and have any color and shape.

The packaging can comprise a multi-layer film 21. The film 21 can comprise a polyolefin. The film 21 can be a fully coextruded shrinkable film 21. The package 23 provides a barrier to gas passing between the interior of the package 23 to the exterior of the package. Accordingly, the environment inside the package 23 is isolated from the environment outside the package. This helps to preserve food products 20 and avoid contamination. This can be advantageous with respect to food hygiene. The package 23 can provide a barrier to aromas or to gasses. This can be particularly useful when the product 20 is a food product 20. The package 23 can be abuse-resistant.

The packaging can be transparent or translucent. This allows a customer to see the product 20 through the packaging. For example, the packaging may comprise a transparent film 21. The packaging film can be anti-fog. This ensures high consumer appeal. The packaging film can be printable. This allows labels to be printed directly onto the packaging.

The packaging may be formed from a roll of film 21. The tubular film 21 can be formed by forming a tube from the roll of film 21. The packaging apparatus 1 can comprise a former configured to form the roll of film 21 into a tube. The former can form the tube by forming a longitudinal seal along the longitudinal edges of the roll of film 21. The tube may be formed from two webs of film 21. In this case, the former forms two longitudinal seals along the opposing edges of the two rolls of film 21.

The packaging apparatus 1 can comprise a flusher 34. The flusher 34 is configured to flush gas through the tube of film 21 that forms the packaging. The gas flush prevents the tube from collapsing. The gas flush helps to maintain a distance between a product 20 in a tray and the film 21. This helps to improve the hygienic appearance of the film 21 because the film 21 remains untarnished by the product 20. The flusher 34 flushes gas longitudinally through the tube. The gas used for flushing can comprise about 70% oxygen and about 30% carbon dioxide or other suitably modified atmosphere.

Additionally, the flush gas allows the product 20 to be packaged in a modified atmosphere. The gas may help to preserve the product 20, prolonging its shelf life. The desired amount of gas inside each sealed package 23 depends on the type of product 20 and the length of shelf life needed.

The amount of gas that remains in the package 22 following the expulsion process can depend on the configuration of the air curtain. The air curtain can be operated at a higher pressure and/or volume in order to expel more gas from the package. The air curtain can be configured by modifying the type, number, and arrangement of the one or more nozzles. The nozzles can be of a slit-shape type, circular, elliptic, or any other suitable type. The controller 50 can be configured to control the flow rate of the flow of gas supplied to outlet 16, the pressure and/or volume of the gas flow, thereby controlling the amount of gas to be expelled.

The packaging apparatus 1 can comprise a shrinking machine configured to shrink the film 21. The shrinking machine may be, for example a shrink tunnel 33, or a hot air tunnel 33. The sealed package 23 is shrunk in the shrinking machine. The shrinking process may involve heating the sealed package. The package 23 may be heated to a temperature within the range of from about 130° C. to about 150° C.

Before the sealed package 23 is shrunk, there may be undesirable gas trapped in the sealed package 23 along with the product 20. Additionally, the sealed package 23 may comprise undesirable "dog ears", where a dog ear is a portion of the packaging that extends away from the product 20 (for example due to the product 20 not being a regular rectangular prism). After the shrinking process the dog ears and the gas content are reduced. This gives the sealed package 23 a more aesthetic appearance. In the case of cheese, the cheese may consume any residual gas that remains in the sealed package 23 following the shrinking step.

The product 20 can be a food product 20. For example, the product 20 may comprise meat, cheese, pizza, ready meals, poultry and fish. The product 20 may be substantially dry, as in the case of cheese. For some products, such as cheese, there is no need for a tray to support the cheese. Alternatively, the product 20 may be wet. In this case, it is particularly desirable for the product 20 to be disposed in a tray.

The packaging process of the invention may be employed to package food products 20 that are to have a shelf life in the region of from about six days to about 14 days, for example.

Desirably, the packaging apparatus 1 comprises a horizontal form fill and seal machine. However, the packaging apparatus 1 may comprise other types of form fill and seal machines, such as a vertical form fill and seal (VFFS) machine. In a vertical form fill and seal machine, the packages 22 move through the packaging apparatus 1 in a vertical direction during the packaging process.

In a VFFS machine, the packaging may be sealed once to form the lower end of a sealed package. The product 20 is then fed into the open-ended package. The top end of the package 22 is then sealed to form a sealed package 23. Before the step of sealing the top end of the package, the process comprises the step of expelling gas from the package.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

The invention claimed is:

1. A device for sealing and cutting a film in a packaging apparatus, comprising:

a first member;

a second member, wherein:

the film is interposed between the first and second members, the first and second members are capable of respect movement to bring the first and second members into contact with the film, the first and second members are configured to form at least one of a transverse seal or a transverse cut in the film in response to the first and second members being brought into contact with the film, and the first and second members longitudinally extend across the film lateral to a movement direction of the film; and a knife on the first member, wherein the knife is movable longitudinally along the first member to a plurality of positions laterally across the film for forming an incision in the film;

wherein the second member comprises a corresponding seating for at least partially receiving the knife, wherein the member further comprises a seat holder configured to delimit the seating, wherein the seat holder is movably coupled to the second member so that the seat holder is movable longitudinally along the second member to a plurality of distinct positions with respect to the second member thereby allowing aligning the seating to the knife, so that when the device is in the second configuration, the seating is configured for receiving the knife.

2. The device of claim 1 wherein:

the device has a first configuration in which the first and second members are member spaced apart from one another, and a second configuration, in which the first and second members are substantially in contact with one another, the first and second members respectively comprise first and second working surfaces, the first and second working surfaces are substantially in contact with each other when the first and second members are in the second configuration, and the first member further comprises a support for the knife.

3. The device of claim 1 wherein the member further comprises abutment elements arranged at opposite first and second ends thereof, wherein the support is movable between a first end-run position in which the support abuts the abutment element located at the first end of the first member and a second end-run position in which the support abuts the abutment element located at the second end of the first member.

4. The device of claim 3 wherein the member is configured to receive, in the support, any one of a plurality of interchangeable knives, wherein each of the plurality of interchangeable knives has at least one of a size, a shape, or a form different from other interchangeable knife, and wherein each of the plurality of interchangeable knives is releasably coupled to the first member.

5. The device of claim 1 wherein the second member further comprises a second mover configured to move the seat holder into any one of the plurality of distinct positions.

6. The device of claim 5 wherein the first member comprises a first actuator configured to act upon a first mover in order to position the knife.

7. The device of claim 5 wherein:

the second member comprises a second actuator configured to act upon the second mover in order to position the seating;

the second mover is operably coupled to the seat holder so that the second mover is configured to position the seating by moving the seat holder, the first mover comprises a first threaded control rod, axially fixed to the first member, so that the first threaded control rod can be rotated about a longitudinal axis thereof without executing a translatory movement;

the first threaded control rod is further rotatably engaged with at least one of the support or seat holder, thereby being configured to move the support or the seat holder between and into the plurality of positions upon rotation of the first threaded control rod.

8. The device according to claim 5 wherein the second mover comprises a second threaded control rod, axially fixed to the second member, so that the control rod can be rotated about a longitudinal axis thereof without executing a translator movement, wherein the second threaded control rod is further rotatably engaged with the support or the seat holder, thereby being configured to move the support or the seat holder between and into the respective plurality of positions upon rotation of the second threaded control rod.

9. The device of claim 5 wherein the first and/or second mover comprise at least one of:

a) a push rod assembly and a pneumatic or hydraulic actuator; or b) a linear motor operably coupled to a linear rack;

wherein at least one of the first and second mover are operably coupled to a control unit, and the control unit is configured to control the at least one of the first and second mover.

10. The device of claim 5 wherein at least one of the first and second mover comprise a lock/unlock mechanism configured to lock a current position of the support and the seat holder in one of a plurality of discrete locking positions along a length of the at least one of the first and second member, respectively.

11. The device of claim 5 wherein:

the first member comprises a first track configured to receive the support, wherein the first track has a shape of a continuous cavity extending along a length of the first member, at least one of the support or the seat holder at least partially occupies the first track, thereby defining one or more regions, adjacent to at least one of the support or the seat holder, and the first member comprises at least one cover, configured to cover the one or more regions, the cover comprising at least one roller carried by the first member in correspondence with the one or more regions and configured to adapt to a size of the one or more regions by releasing or retracting a rolled-up cover, the at least one roller rotatably coupled to the support or the seat, and an end of the rolled-up cover coupled to the abutment element.

12. The device of claim 5 wherein:

the second member comprises a second track configured to receive the seat holder;

the second track has a shape of a continuous cavity extending along a length of the second member;

the support or the seat holder at least partially occupies the second track, thereby defining one or more regions adjacent to the support or the seat holder; and the second member comprises at least one cover, configured to cover the one or more regions, the at least one cover comprising at least one roller carried by the second member in correspondence with the one or more regions and configured to adapt to a size of the one or more regions by releasing or retracting a rolled-up cover, the at least one roller rotatably coupled to the support or the seat, and an end of the rolled-up cover is coupled to the abutment element.

13. The device of claim 5 wherein one of the first and second members comprises an elongated blade configured to cut the film substantially perpendicularly to the movement direction of the film.

14. A process for sealing and cutting in a packaging apparatus comprising the device of claim 1, the process comprising the steps of:

a) creating a first seal on a tubular film, thereby creating a semi-sealed package;

b) creating a second seal on the semi-sealed package, thereby creating a sealed package; and c) creating a substantially transversal cut in the tubular film, thereby separating the semi-sealed package or the sealed package from a subsequent portion of the tubular film;

wherein the step of creating the first seal or the step of creating the second seal comprises creating an incision in a section of the first or second seal, the incision defining a pre-determined breaking zone in the tubular film of the sealed package.

15. The process of claim 14 further comprising modifying at least one of a position or an orientation of the knife in order to configure at least one of a length, a position, or an orientation of the incision in the first seal of the sealed package, thereby facilitating at least one of breaking of the second seal or rupture of the film along the pre-determined breaking zone of the sealed package upon pulling the film apart on either side of the pre-determined breaking zone.

16. The device of claim 1, wherein the knife is positionable at one of the plurality of positions laterally across the film based on a pre-determined rupture zone in a region of the film.

17. The device of claim 1, wherein the knife is positionable at one of the plurality of positions laterally across the film based on a respective position of a product in the film.

18. The device of claim 1, wherein a length of the incision is less than a length of the at least one of a transverse seal or a transverse cut.

19. A packaging apparatus comprising:

a) a control unit;

b) a loading station configured to position a tubular film around a product to be packaged;

c) a sealing station coupled to the control unit, the sealing station comprising a device according to claim 1, the control unit being configured to control the sealing station to create one or more seals on the tubular film;

d) an output station; and e) at least one conveyor of the products from the loading station towards and through the sealing station and towards the output station.

20. The packaging apparatus of claim 19 further comprising an evacuation mechanism, wherein:

the control unit is configured to control the sealing station to create a first seal on the tubular film, thereby forming a first sealed end and creating a semi-sealed package containing the product to be packaged, the semi-sealed package having a second open end, the evacuation mechanism coupled to the control unit;

the control unit configured to expel gas present within the semi-sealed package;

the at least one conveyor being configured to move the semi-sealed package, the at least one conveyor being coupled to the control unit, the control unit being configured to control the at least one conveyor to move the semi-sealed package;

the control unit further configured to control the sealing station to create a second seal on the tubular film, thereby sealing the second open end, forming a second sealed end spaced apart from the first sealed end, and creating a sealed package containing the product to be packaged.

* * * * *